US005212995A

United States Patent [19]

Robinson et al.

[11] Patent Number: 5,212,995

[45] Date of Patent: May 25, 1993

[54] PROFILER DEVICE

[76] Inventors: Melvin E. Robinson, 4021 Augustine, Sterling Heights, Mich. 48310; Joseph E. Robinson, 167 W. Shevlin, Hazel Park, Mich. 48030

[21] Appl. No.: 805,852

[22] Filed: Dec. 10, 1991

[51] Int. Cl.[5] ..... F16H 21/22; F16C 19/54

[52] U.S. Cl. ..... 74/44; 29/898.07; 51/170 TL; 384/454; 384/541

[58] Field of Search ..... 74/44, 49, 55; 51/170 TL; 29/898.07, 898.08; 384/454, 541

[56] References Cited

U.S. PATENT DOCUMENTS

| | | | |
|---|---|---|---|
| 2,271,336 | 1/1942 | Goldsmith | 384/541 |
| 2,690,081 | 9/1954 | Bjorklund et al. | 74/44 |
| 2,832,969 | 5/1958 | Kistler | 384/454 X |
| 3,007,230 | 11/1961 | Riedl | 74/44 X |
| 3,416,848 | 12/1968 | Recknagel | 384/454 |
| 3,626,768 | 12/1971 | Dancsik | 74/44 |
| 3,734,583 | 5/1973 | Hosnedl et al. | 384/541 X |
| 3,926,484 | 12/1975 | Parkins | 384/454 |
| 4,233,850 | 11/1980 | Edwardson | 74/44 |
| 4,512,207 | 4/1985 | Dancski | 74/44 |
| 4,593,579 | 6/1986 | Oszut | 74/44 X |

*Primary Examiner*—Allan D. Herrmann
*Attorney, Agent, or Firm*—Remy J. VanOphem

[57] ABSTRACT

A profiler particularly adapted for finishing the surfaces and contours of dies and molds. The profiler employs a cam assembly which converts rotary input motion to reciprocating output motion for operating a reciprocating member having a suitable tool attached thereto. The profiler is designed to generate substantially lower temperatures within the bearings supporting the cam assembly, and the bearings themselves are particularly designed to be easily replaceable in a sleeve which, with the bearings, form a bearing cartridge. The use of the bearing cartridge eliminates the need to individually install each bearing within the housing of the profiler. The bearing cartridge also includes a shaft which delivers the rotary motion from an external source to the cam assembly. Both the cam assembly and the bearing cartridge are disposed within a cavity in the housing. The portion of the profiler within which the reciprocating member is housed is also designed to prevent contaminants from entering the interior of the housing. Consequently, the useful life of the profiler and its internal components is increased, while also facilitating maintenance and rebuilding procedures.

19 Claims, 2 Drawing Sheets

Fig-3
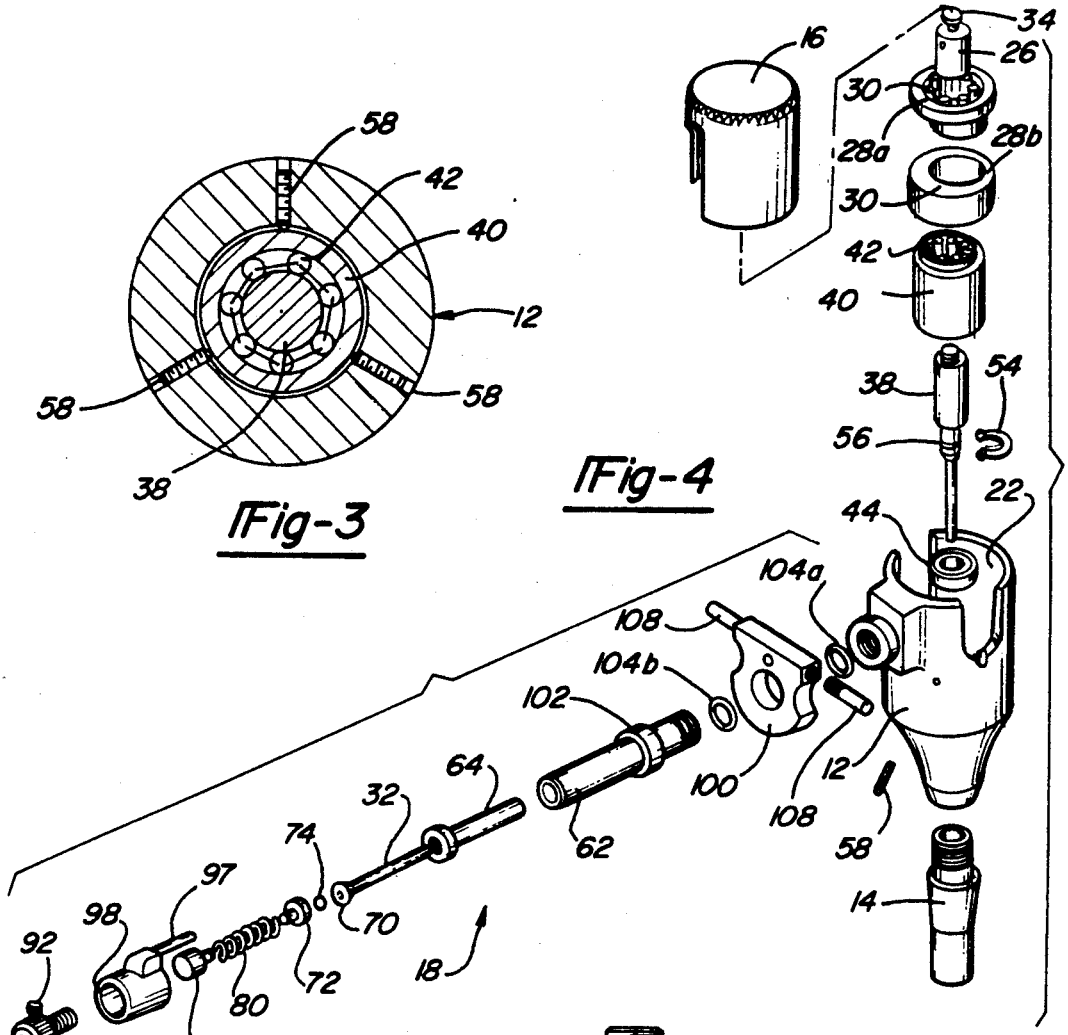
Fig-4
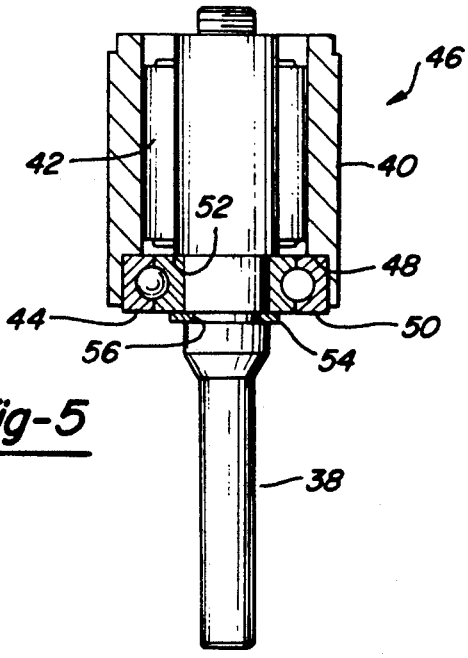
Fig-5

PROFILER DEVICE

BACKGROUND OF THE INVENTION

1. Field of the Invention

The present invention generally relates to a powered hand tool whose output provides a reciprocating motion. More specifically, this invention relates to a profiler whose reciprocating output is used to reciprocate any one of various attachments which are used to finish contoured surfaces such as those found on a die or mold, wherein a bearing cartridge is provided which better tolerates the cyclic loading transferred through a cam actuated device which produces the reciprocating motion.

2. Description of the Prior Art

As produced, machined and cast articles have generally moderate to poor surface finishes which are nevertheless acceptable for many uses. However, where it is essential that a machined or cast article have a superior surface finish, such as when the article is a die or molding for use in the extrusion or casting of a metal or plastic product, it is imperative that the surface of the article undergo a process which removes any surface irregularities and burrs which would otherwise adversely affect the end product. An appropriate cutting or abrasive tool is used by an operator to carefully remove irregularities from the article's surface, with particular care given to sharp surface contours which are more difficult to form.

To assist in such operations, powered hand tools which provide a reciprocating output, generally referred to as profilers, are known in the art. The reciprocating output of a profiler is used to reciprocate a suitable attachment, such as a cutting or abrasive tool, which can then be directed at the surface areas of the article for which additional surface finishing is needed. Preferably, the stroke length is adjustable with a maximum stroke of approximately one quarter inch being typical.

Essentially, the reciprocating output of the profiler is derived from a drive rod which follows a cam rotated by an external source. Though capabilities vary according to the particular design, speeds of as much as 22,000 rpms are known, with speeds of up to 5,000 rpms probably being the most common and associated with the more durable designs. The external source for rotating the cam can be either a remote hydraulic or electric-powered unit, preferably being equipped with a speed control unit which allows the operator to adjust the profiler's speed according to the finishing process being undertaken. The external source transmits the rotary motion to the cam through a suitable cable, such as a flexible drive shaft protected within a sheath.

An early example of a profiler is illustrated in U.S. Pat. No. 2,690,081 to Björklund et al. There, a generally cylindrical housing is shown within which a shaft and cam assembly is longitudinally disposed. The cam reciprocates a radially extending rod one full stroke cycle with each rotation of the shaft. The rod transfers the reciprocating motion to a tool attachment, which in turn reciprocates a tool secured therein. As a consequence of the high side loads transmitted by the rod to the cam and shaft assembly, a pair of bearings are shown in a spaced apart manner to support the shaft. The bearings are spaced apart to minimize stresses which would otherwise be amplified if the shaft were merely supported by a pair of bearings at one end in a cantileverstyle arrangement. As shown, the upper bearing absorbs the brunt of the side loading, while the lower bearing primarily acts to stabilize the cam and shaft assembly. A similar bearing arrangement is shown in U.S. Pat. No. 4,233,850 to Edwardson.

A disadvantage with the arrangement taught by Björklund et al and Edwardson is that when maintenance is required on the profiler the cam and shaft assembly must be separated from their bearings. Moreover, the upper bearing must be installed well within the housing, making it difficult to both install and provide an adequate fit between the bearing and the housing to prevent movement therebetween. A further disadvantage is that the material removed from the article being finished is able to enter the bore housing the reciprocated rod, which can quickly degrade the components at the speeds at which the profiler operates.

Alternative bearing arrangements are taught in U.S. Pat. No. 3,007,230 to Riedl and U.S. Pat. No. 4,593,579 to Öszüt. There, a pair of bearings are positioned on both sides of the cam so as to avoid any cantilever loading on the shaft and better distribute the side load between the bearings. However, access is again complicated for maintenance purposes by requiring that one of the bearings be removed prior to gaining access to the cam device. The procedure for assembling the devices taught by Riedl and Öszüt is especially complicated in that the bearings are each retained within a separate housing member, furthering the propensity for the bearings to be misaligned.

U.S. Pat. Nos. 3,626,768 and 4,512,207 to Dancsik illustrate another suggested bearing arrangement, wherein the bearings are mounted close together on only one side of the cam. Though having gained commercial acceptance, it is apparent that the bearings of the Dancsik profiler are required to sustain substantial side loading which is unevenly distributed between the bearings, the bearing closest to the cam sustaining the greatest side load as a result of the shaft being supported as a cantilever. The loading on this bearing is sufficiently high such that significant heat is generated by the rolling resistance of the bearing, particularly in the case of the ball bearing shown due to the point contact between each ball and the race. One problem caused by the heat buildup is the discomfort of the operator while holding the profiler. But, more significantly, the resulting high temperatures shorten the life expectancy of the bearing by reducing the effectiveness of the bearing's lubrication, while also causing the outer race of the bearing to loosen from its pressfit as a result of the differences in the coefficient of expansion between the steel bearing and the aluminum housing in which it is mounted. Loosening of the outer race allows the bearing to rotate adversely affecting the life of the bearing as well as contributing to the already existing localized heat problems. As a result, the bearings are highly susceptible to premature wear and failure, requiring frequent replacement.

A partial solution to this heat problem is to provide a poorly conducting sleeve, such as one made of plastic, which can be fit over the handle of the profiler to protect the operator. However, such a remedy does nothing to dissipate the heat from the bearings. Another attempted solution to this problem has been to remove the side shields on the bearings to allow the heat to dissipate from the rolling elements of the bearings. However, such an attempt has proven to be inadequate in significantly reducing the temperature of the bearings and their environment. Moreover, the lubrication which would otherwise be retained by the shields in the upper bearing tends to migrate downward when the shield is removed, further contributing to the generation of heat and eventual bearing failure. Attempts to ventilate the bearing, including the use of forced air between the bearings, have also proved to be unsatisfactory in that inadequate cooling is achieved.

What can be further seen from the profiler taught by Dancsik is that both bearings must be press fit into a recess which is well within the housing. As a consequence, maintenance and replacement of the bearings is greatly complicated, requiring extra care when removing and installing the bearings so as not to damage the recess in which the bearings are located. Another disadvantage is the possibility of debris contaminating the bore containing the reciprocating rod, leading to degradation of the internal components of the profiler. The passage to which a tool is attached to the profiler acts as an entrance to the interior of the profiler, exposing a spring, ball and the reciprocated rod to highly abrasive contaminants. When an unyielding surface is impacted with the attached tool, the reciprocated rod can be lifted from its seat, allowing the contaminants to enter the housing itself. Consequently, the profiler taught by Dancsik is also highly susceptible to premature wear and failure from contaminants.

From the above discussion, it can be readily appreciated that the prior art does not disclose a profiler which has the advantage of providing a bearing arrangement which facilitates the removal and/or installation of the bearings while also reducing the generation of heat built-up by the bearings as well as is conducive to the dissipation of the generated heat within the environment. Nor does the prior art teach or suggest an effective method for preventing machining abrasives and debris from entering the profiler's housing.

Accordingly, what is needed is a profiler having a rugged design which acts to reduce and better dissipate the heat generated within the bearings which support the cam and shaft assembly, while also effectively protecting the internal components of the profiler from contamination by debris, thus enhancing the maintainability of the profiler, and in particular the removal and replacement of the bearings.

SUMMARY OF THE INVENTION

According to the present invention there is provided a power hand tool which is designed to be particularly adapted to finishing the intricate surfaces and contours of dies and molds used to cast or extrude articles. The hand tool of the present invention is a profiler which converts rotary motion to reciprocating motion through a cam and follower arrangement enclosed within a rigid housing. The profiler of the present invention is designed to generate substantially lower temperatures within the bearings supporting the cam, and the bearings themselves are particularly designed to be easily replaceable as a cartridge unit which eliminates the need to individually install each bearing within the housing. A portion of the profiler within which the follower is housed is designed to prevent contaminants from entering the interior of the housing. Consequently, the useful life of the profiler and its internal components is increased, while also facilitating maintenance procedures.

The profiler includes a housing having a generally longitudinally extending cavity therein and a bore formed within and a bore formed within an elongate portion extending radially from the housing. A reciprocating member is disposed within the bore so as to partially extend into the cavity of the housing. Engaging the portion of the reciprocating member within the cavity is a camming device, which is disposed within the cavity so as to have an axis of rotation oriented longitudinally within the housing. Engaging one end of the camming device so as to be coaxial with its axis of rotation is a transmission assembly disposed within the cavity. A handle is secured to the end of the housing within which the transmission assembly is located. The handle provides a passage through which a rotating member is inserted to engage the transmission device for driving the camming device.

The transmission assembly includes a shaft which is secured to the camming device for rotating the camming device. In addition, the transmission assembly includes a cylindrical sleeve which closely fits within the cavity to minimize relative movement therewith. The shaft is rotatably supported within the longitudinal bore by a pair of bearings. The bearing nearest the camming device is preferably a needle bearing, having the advantage of superior load distribution as compared to a roller bearing of the same general size. Both bearings are press fit into the cylindrical sleeve and a snap ring is used as a safeguard to retain the shaft within the cylindrical sleeve. The cylindrical sleeve, shaft and bearings thereby form a bearing cartridge which can be easily assembled and disassembled from the housing as a unit.

The bore within the radially extending portion of the housing contains a sleeve in which is disposed one end of a drive member, a pair of seat members, and a spring located between the spring seats. The drive member, serving as the follower of the cam and follower arrangement, slidably resides within the sleeve and mechanically communicates with the camming device. The seat members are disk-shaped to closely fit the bore defined by the sleeve. The spring biases the second seat member, which is located toward the end of the radially extending portion, away from the first seat member, which abuts the drive member. Both the first and second seat members are sufficiently sized so as to provide a barrier to entry by contaminants and machining debris. An attachment device to which a tool can be mounted is secured to the sleeve and serves as an abutment for the second seat member. With this arrangement, the camming device reciprocates the attachment device through the sleeve, while the sleeve is reciprocated by the drive member, the first seat member, the spring and the second seat member, respectively, working as a unit.

According to a preferred aspect of this invention, the bearing cartridge is a self-contained assembly which is installed and removed from the housing as a readily accessible unit. Consequently, the bearings housed within the bearing cartridge can be installed prior to the bearing cartridge being installed within the housing, and similarly removed after the bearing cartridge has been removed from the housing. Without the need to individually install each bearing within the housing and the use of a bearing cartridge, the building and maintenance procedures for the profiler are greatly simplified.

Further, the bearings are selected and positioned to better sustain the significant side loads transmitted through the drive member and cam to the shaft of the bearing cartridge. The bearing closest the camming device, which sustains the greatest loading, is preferably a needle bearing which has the mechanical advantage of better distributing, and thus sustaining, the side loads transmitted. The second bearing, which is spaced apart from the needle bearing and is required to sustain side loads which are much less than that of the needle bearing, is preferably a roller bearing having a low rolling resistance. With this preferred arrangement, the temperature generated by the rolling friction of the bearings is significantly less than that of the prior art. An added advantage is that the cylindrical sleeve serves as a heat sink to conduct the heat away from the bearings while the aluminum housing further aids in heat dissipation and removing heat from the environment of the bearings.

In addition, a significant advantage of the present invention is that the first and second seat members within the bore of the radially extending portion of the housing provide a barrier to entry by contaminants. Accordingly, degradation to the internal components of the profiler due to contaminants is greatly diminished, extending both the time between maintenance and the overall life of the profiler.

Accordingly, it is an object of the present invention to provide a profiler whose cam and associated shaft are supported by bearings which can better sustain the side loading of the reciprocating motion produced by the cam, resulting in less heat being generated by the bearings.

It is a further object of the invention that the profiler be able to better disperse the heat generated by the rolling resistance of the bearings.

It is still a further object of the invention that such a profiler employ a bearing cartridge which houses the bearings supporting the cam and shaft within a self-contained unit so as to facilitate building and maintenance of the profiler.

It is another object of the invention that external contaminants and debris be prevented from entering into the interior of the profiler so as to minimize degradation of the profiler's internal components from such debris.

It is yet another object of the invention that such a profiler be designed to be ergonomically suited for extended use by an operator.

It is still another object of the invention that the internal components of the profiler be readily accessible for purposes of maintenance and repair.

Other objects and advantages of the invention will be more apparent after a reading of the following detailed description taken in conjunction with the drawings provided.

BRIEF DESCRIPTION OF THE DRAWINGS

FIG. 3 is a cross-sectional view of the housing and bearing cartridge along line 3—3 of FIG. 2 in accordance with the preferred embodiment of this invention;

FIG. 4 is an exploded view of the profiler of FIG. 1; and

FIG. 5 is a cross-sectional side view of the bearing cartridge in accordance with the preferred embodiment of this invention.

DETAILED DESCRIPTION OF THE PREFERRED EMBODIMENT

Figure 1:
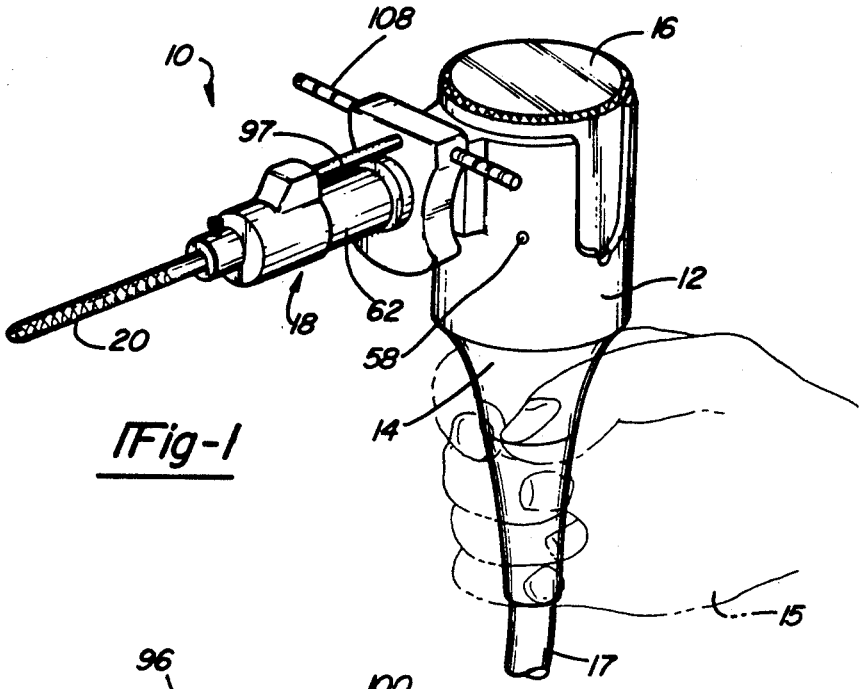
FIG. 1 is a perspective view of a profiler in accordance with the preferred embodiment of this invention.

With reference to FIG. 1, there is shown a profiler 10 which includes a generally cylindrical housing 12, a handle 14, a dust cap 16, and a radially extending portion 18 to which a suitable tool 20 can be attached. The housing 12 is preferably formed from extruded aluminum, providing a more dense and harder material while retaining the machining characteristics of the aluminum. Aluminum is also preferred for considerations of weight. For the same reasons, the handle 14 is also formed from extruded aluminum. The handle 14 is preferably removably secured to the housing, such as with the threads best shown in FIG. 2. With the handle 14, the lower end of the housing 12 is ergonomically tapered with one or more contours which comfortably fit the hand 15 of an operator during operation of the profiler 10.

Figure 2:
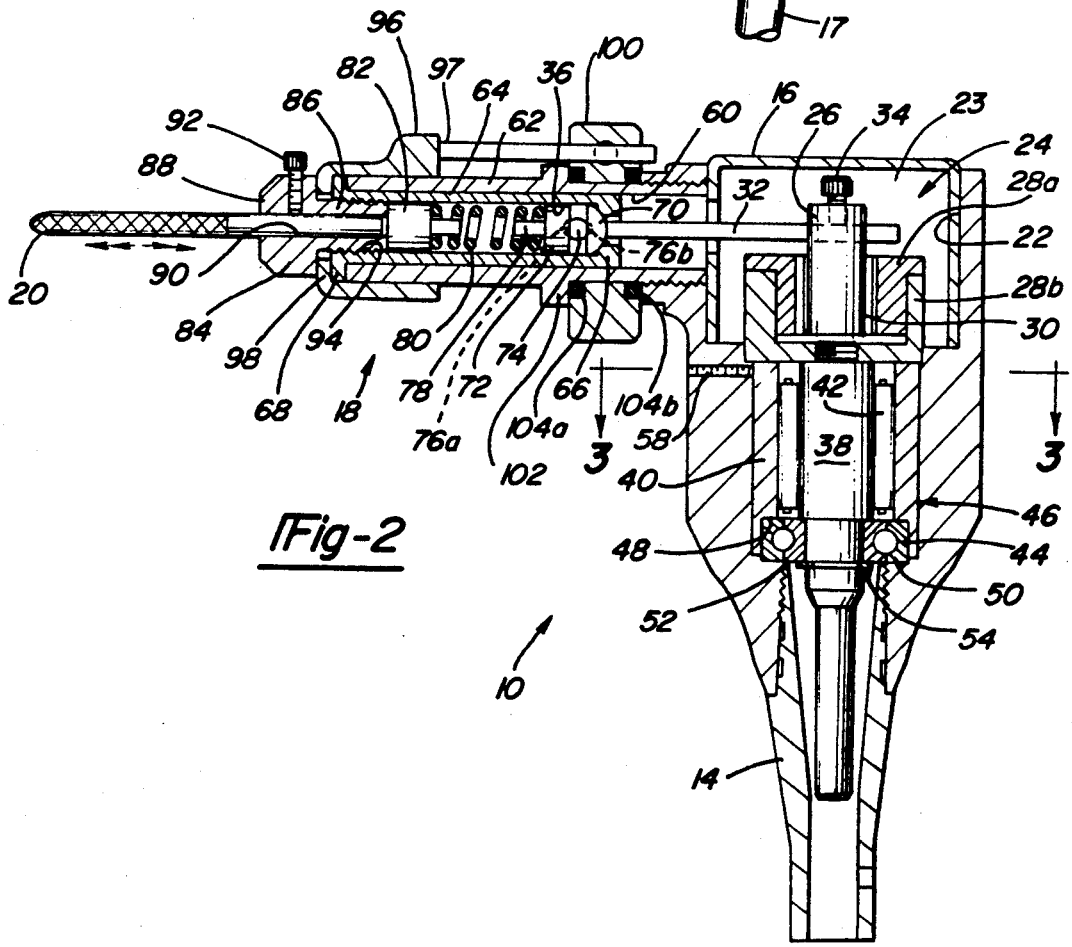
FIG. 2 is a cross-sectional side view of the profiler of FIG. 1.

As best seen in FIG. 2, the profiler 10 has a cavity 22 provided with an access 23 in the top of the housing for purposes of maintenance and repair of the internal components of the profiler 10. A cam assembly 24 is disposed in an upper portion of the cavity 22. The cam assembly 24 acts to convert rotational motion provided from an external source (not shown) into a reciprocating motion. The cam assembly 24 is mounted on a shaft 38. The cam assembly consists of a male component **28*a* and a female component 28*b*. The female component 28*b* is counter-weighted by a hole therein which hole is offset from the central axis of the male component, such that the male and female components may be rotated with respect to each other in order to permit adjustability for the eccentric stroke. In operation, the female and male components are fixed relative to each other once the desired stroke is selected. A drive pin 26 is mounted in a bearing 30 mounted in a central hole within the male component 28*a* of the cam assembly. The drive pin 26 has a transverse hole for receiving a connecting rod 32 and secured thereto by a locking screw 34, and extends into a bore 36 defined within the radially extending portion 18**, as will be explained more fully below.

The shaft 38 is threadably secured to the cam assembly 24 and extends downwardly through a cylindrical sleeve 40. The cylindrical sleeve 40 and the shaft 38 are both preferably formed from steel for purposes of strength as well as heat capacitance for absorbing heat. The cylindrical sleeve 40 closely fits within a lower portion of the cavity 22, preferably with a diametral clearance of no more than 0.0005 inches. As seen in FIG. 3, the cylindrical sleeve 40 is retained in the lower portion of the cavity 22 by three set screws 58 which extend radially inward from the perimeter of the housing 12. Supporting the shaft 38 within the cylindrical sleeve 40 are a pair of bearings 42 and 44. The upper bearing is preferably a needle bearing 42, while the lower bearing is preferably a roller bearing 44. In practice, a drawn-cup needle bearing 42 with a roller cage has been found to be preferable, exhibiting sufficient load capacity while accommodating higher speeds and greater misalignment than a needle bearing without a roller cage.

As best seen in FIG. 5, the cylindrical sleeve 40, shaft 38, and bearings 42 and 44 form a bearing cartridge 46. Both the needle bearing 42 and the roller bearing 44 are press fit into the cylindrical sleeve 40 so as to be positively retained within the bearing cartridge 46. As can be seen in FIG. 5, the needle bearing 42 is press fit through the left end of the cylindrical sleeve 40 until flush with the surrounding end surface of the cylindrical sleeve 40. The roller bearing 44 is pressed in from the opposite end until the inward surface of the roller bearing 44 abuts against a shoulder 48 formed within the cylindrical sleeve 40. When fully installed, the roller bearing 44 extends approximately 1/32 of an inch beyond the end surface of the cylindrical sleeve 40, assuring that pressure can be applied exclusively to an outer race 50 of the roller bearing 44 as it is being pressed into the cylindrical sleeve 40. No adverse effect has been noted with the preload on the roller bearing 44 by allowing it to protrude from the bearing cartridge 46. The shaft 38 is then inserted into the cylindrical sleeve 40 through the end containing the needle bearing 42. A shoulder 52 formed on the shaft 38 abuts the inward face of the roller bearing 44 which, in cooperation with a circlip 54 engaged in a circumferential groove 56 located on the shaft 38, retains the shaft 38 within the cylindrical sleeve 40. As assembled, the bearing cartridge 46 can be installed as a unit into the cavity 22 of the housing 12, thereby avoiding the need to individually install each bearing 42 and 44 within the cavity 22. No force is required to install the bearing cartridge 46 within the cavity due to the diametral clearance provided between the cylindrical sleeve 40 and the cavity 22.

As shown in FIG. 2, the shaft 38 extends downward from the cylindrical sleeve 40 so as to be partially suspended within the handle 14. To gain access to the shaft 38, the handle 14 can be readily removed due to the handle 14 being threadably secured to the housing 12. The handle 14 is adapted to receive a suitable drive cable 17 (shown in FIG. 1) to be attached to the shaft 38 for providing the rotational input to the profiler 10. In case of wear experienced as a result of the drive cable rubbing against the handle, the handle can conveniently be replaced by merely removing the drive cable, unscrewing the handle from the housing, and replacing the handle and reattaching the drive cable. Any convenient known method of attaching the cable to the shaft 38 can be employed, such as providing a diametrical slot through the shaft 38 or a flat on the perimeter of the shaft 38, while providing a cooperating feature on the cable to positively engage the cable with the shaft 38.

With further reference to FIG. 2, the radially extending portion 18 houses a reciprocating mechanism to which the tool 20 can be attached. The radially extending portion 18 primarily consists of an elongate tubular member 62 which is threadably secured to the housing 12. The tubular member 62 forms a bore 60 in which is disposed a sleeve 64. The sleeve 64 defines the bore 36 described above in which the connecting rod 32 is disposed. The end of the sleeve 64 nearest the housing 12 has an integrally-formed annular seat 66. The surface of the annular seat 66 facing the interior of the sleeve 64 is concave, having a generally semispherical contour. The opposite end of the sleeve 64 has a radially outward extending shoulder 68 which abuts against the end of the tubular member 62 furthest from the housing 12. The shoulder 68 prevents the sleeve 64 from being completely inserted into the bore 60. Internal threads 94 are formed in the bore 36 at the end having the shoulder 68 for a purpose to be described below.

The connecting rod 32, serving as a follower for the cam assembly 24, extends through the annular seat 66 to engage the cam assembly 24. The connecting rod 32 has a semispherical head 70 on its end opposite the cam assembly 24 for mating with the semispherical contour of the annular seat 66. Disposed within the bore 36 and adjacent the connecting rod 32 is a disk-shaped first seat 72 having a planar surface on the end nearest the connecting rod 32. The connecting rod 32 and the first seat 72 mechanically communicate through a spherical ball 74 disposed therebetween. Both the semispherical head 70 of the connecting rod 32 and the planar surface of the first seat 72 are provided with semispherical depressions **76*a* and 76*b* within which the spherical ball 74 is retained. Each of the depressions 76*a* and 76*b* are aligned to be on the axis of the bore 36 within the sleeve 64 to ensure that a balanced force can be transmitted through the spherical ball 74 from the connecting rod 32 to the first seat 72**.

Extending from the end opposite the semispherical depression **76*a* of the first seat 72 is a reduced diameter portion 78. The reduced diameter portion 78 serves as a pilot for a spring 80 which is fitted over the reduced diameter portion 78 and extends in a direction toward the internal threads 94 of the sleeve 64. In a similar manner, the spring 80 is piloted at its opposite end by a second seat 82 which is located near the internal threads 94 of the sleeve 64. The spring 80 serves to bias the first seat 72 against the spherical ball 74 and the connecting rod 32, and away from the second seat 82 disposed at the opposite end of the bore 36. Both the first and second seats 72 and 82 are sufficiently sized so as to closely fit within the bore 36, providing a barrier to entry by contaminants and machining debris generated while the profiler 10** is in use.

The second seat 82 abuts a tool attachment 84 which has a threaded end 86 and an oppositely disposed annular end 88 to which the tool 20 can be attached. The threaded end 86 threadably engages the cooperating internal threads 94 of the bore 36 to securely retain the tool attachment 84 to the sleeve 64. The threaded end 86 and the annular end 88 together form a continuous aperture 90 through the tool attachment 84 through which the shaft of the tool 20 can be inserted. The tool 20 is then positively retained on the tool attachment 84 by a set screw 92. From the above, it can be seen that the cam assembly 24 reciprocates the tool 20 through a spring-loaded assembly enclosed by the sleeve 64. With the connecting rod 32 rigidly mounted to the drive pin 26 which in turn is located in the bearing 30 secured to the cam assembly 24, the spring 80 serves to absorb any lost motion caused when the tool 20 abuts an unyielding surface, while transmitting the reciprocating motion of the connecting rod 32 through the first and second seats 72 and 82 to the tool attachment 84.

As previously noted, the shoulder 68 on the sleeve 64 prevents the sleeve 64 from being completely inserted into the bore 60 of the tubular member 62, and thus limits the stroke of the tool attachment 84 toward the housing 12 during operation. The rotation of the tool attachment 84 on the tubular member 62 is also restrained to provide better control of the tool 20. For this purpose, a collar 96 is slidably disposed over the end of the tubular member 62. A radial shoulder 98 extends inwardly between the tool attachment 84 and the shoulder 68 of the sleeve 64, being retained there when the threaded end 86 of the tool attachment 84 is threaded into the bore 36 of the sleeve 64. Thus, the collar 96 reciprocates with the tool attachment 84 and sleeve 64 on the end of the tubular member 62.

Extending from the tool attachment 84 and towards the housing 12 is an alignment rod 97 which is oriented to be substantially parallel to the tubular member 62. Disposed between the housing 12 and a peripheral shoulder 102 on the external surface of the tubular member 62 is an annular collar 100. The annular collar 100 can be rotated by hand on the external surface of the tubular member 62, a pair of O-rings 104*a* and 104*b* being provided in grooves on the internal diameter of the annular collar 100 to provide frictional resistance to accidental rotation. To assist the operator in rotating the annular collar 100, and thus the tool attachment 84 and the tool 20, a pair of pins 108 extend from the annular collar 100 to provide the operator with additional leverage. By allowing such adjustment, the orientation of the tool 20 can be altered to adapt to the article being finished. The adjustment can be made while the profiler 10 is either operating or off.

In operation, the profiler 10 can be powered by any suitable form of power source, such as an electrically or hydraulically operated motor (not shown). The motor drives the cable 17 which is detachably secured to the shaft 38 of the bearing cartridge 46. Where desired, a speed control device can be used to regulate the rotational speed provided by the cable to the shaft 38. The rotative motion of the shaft 38 is then transmitted to the cam assembly 24, which cyclically reciprocates the connecting rod 32. As noted above, the sleeve 64 and its spring-loaded internal components—the spherical ball 74, the first and second seat members 72 and 82, the spring 80, and the tool attachment 84—all reciprocate together, imparting the reciprocating motion to the tool 20 through its attachment to the tool attachment 84. If the tool 20 happens to be forcibly stopped short of a full stroke, the semispherical head 70 of the connecting rod 32 is forced from the annular seat 66, compressing the spring 80 to expand the lost motion.

A significant advantage of the profiler 10 of the present invention is that the bearing cartridge 46 is a self-contained assembly which is installed and removed from the housing 12 as a single unit. Consequently, the needle bearing 42 and the roller bearing 44 housed within the bearing cartridge 46 can be installed prior to the bearing cartridge 46 being installed within the housing 12. The bearing cartridge 46 can then be easily inserted through the access 23 into the lower portion of the cavity 22 and positively retained by the three set screws 58. The cam assembly 24 can be secured to the shaft 38 prior to or after the bearing cartridge 46 is installed. Similarly, the bearings 42 and 44 can be removed after the bearing cartridge 46 has been removed from the housing 12. The extra skill and care which would otherwise be required to individually install each bearing 42 and 44 within the housing 12 without damaging the bearings 42 and 44 is avoided, which simplifies the rebuilding and maintenance procedures for the profiler. This is especially beneficial in that the additional care necessary to install a needle bearing makes the direct installation of the needle bearing 42 into the housing 12 impractical.

In addition, the bearings 42 and 44 are selected and positioned to better sustain the significant side loads transmitted through the connecting rod 32 and cam assembly 24 to the shaft 38. The needle bearing 42, which sustains side loading which is approximately five times greater than that of the roller bearing 44, is specifically chosen for its mechanical advantage of having better load distribution characteristics as a result of its greater rolling surface. The roller bearing 44 is spaced apart from the needle bearing 42 so as to reduce the side loading of the needle bearing 42. With this preferred arrangement, the temperature generated by the rolling friction of the bearings 42 and 44 is significantly less than that of the prior art. An added advantage is that the steel material of the cylindrical sleeve 40 serves as a heat sink to conduct the heat away from the bearings 42 and 44. A further benefit is that the shields on the bearings 42 and 44 can remain in place because the heat generated is sufficiently less than the prior art, such as that which was noted with Dancsik. Accordingly, lubrication retention is better.

Another significant advantage of the present invention is that the first and second seats 72 and 82 within the bore 36 of the sleeve 64 provide a constant barrier to entry by contaminants, a particular hazard due to the machining debris generated by the use of the profiler 10. This contrasts with the prior art of Dancsik, which permits contamination of the interior of the reciprocating mechanism when no tool is present in the tool attachment's aperture. Subsequently, if the tool is abruptly stopped short of its full stroke during operation, the contaminants are free to enter the cavity of the profiler when the connecting rod head lifts off its seat. Accordingly, with the present invention, degradation to the internal components of the profiler 10 due to contaminants is greatly diminished, extending both the time between maintenance and the overall life of the profiler 10.

The present invention, therefore, provides a profiler 10 whose construction can better sustain the side loading of the reciprocating motion produced by the cam assembly 24, resulting in less heat being generated by the bearings 42 and 44 which support the cam assembly 24. The profiler 10 is also able to better dissipate any heat generated by the bearings 42 and 44 by containing them within the steel bearing cartridge 46 which acts as a heat sink. The bearing cartridge 46 serves as a self-contained unit which simplifies the rebuilding and maintenance of the profiler 10, allowing the bearings 42 and 44 to be installed in the bearing cartridge 46 prior to the bearing cartridge 46 being installed in the housing 12. The cam assembly 24 and the bearing cartridge 46 are both readily accessible for purposes of maintenance and repair through the access 23 in the top of the housing 12. The profiler 10 also is able to better prevent external contaminants and debris from entering the interior of the profiler 10 to avoid the resulting degradation of the profiler's internal components. Finally, the handle 14 of the profiler 10 is ergonomically designed with one or more peripheral contours to provide added comfort during extended use of the profiler 10 by an operator.

While the invention has been described in terms of a preferred embodiment, it is apparent that other forms could be adopted by one skilled in the art. Accordingly, the scope of the invention is to be limited only by the following claims.

What is claimed is:

1. A reciprocating hand tool comprising:

a housing having a cavity therein and a bore extending radially from said cavity;

a tubular member mounted to said housing, said tubular member having a bore aligned with said bore extending radially from said cavity of said housing;

a sleeve member having one end mounted in said bore of said tubular member, said sleeve member having a bore therein and an annular seat disposed at one end of said bore;

camming means disposed within said cavity of said housing;

a drive member in mechanical communication with said camming means, said drive member having a head portion mounted in said bore of said sleeve member and engaging said annular seat of said bore, said drive member further having a body portion extending through said annular seat in said bore and attached to said camming means;

a first member mounted in said bore of said sleeve member, said first member having a planar surface at one end facing said drive member and a reduced diameter portion at an opposite end;

a spherical member disposed between said head portion of said drive member and said planar surface of said first member;

a second member disposed within an end opposite said one end of said bore of said sleeve member;

means for biasing said second member in a direction away from said first member;

attachment means mounted in said bore of said sleeve member, said attachment means abutting said second member; and a transmission assembly disposed within said cavity, said transmission assembly being in mechanical communication with said camming means for transferring rotative motion to said camming means, said transmission assembly comprising:

a cylindrical sleeve disposed within said cavity, said cylindrical sleeve having a longitudinal bore extending therethrough;

a shaft disposed within said longitudinal bore; and bearing means disposed between said shaft and said cylindrical sleeve for rotatably supporting said shaft within said longitudinal bore;

wherein reciprocating motion induced by said camming means reciprocates said attachment means through said drive member, said spherical member, said first member, said means for biasing and said second member, respectively.

2. The reciprocating hand tool of claim 1 wherein said bearing means comprises a pair of bearings, one of said pair of bearings being an elongate bearing.

3. The reciprocating hand tool of claim 2 wherein said transmission assembly comprises a self-contained cartridge, said pair of bearings being press-fit into opposing ends of said longitudinal bore so as to retain said shaft within said longitudinal bore.

4. The reciprocating hand tool of claim 2 wherein said elongate bearing comprises a needle bearing.

5. The reciprocating hand tool of claim 2 wherein a second of said pair of bearings is a roller bearing.

6. The reciprocating hand tool of claim 1 further comprising handle means detachably secured to said housing, said handle means having first and second contours which define gripping surfaces.

7. The reciprocating hand tool of claim 1 wherein said housing is an aluminum housing.

8. A profiler comprising:

a housing having a first end and an oppositely disposed second end, said housing having a cavity disposed in said first end along an axis of said housing;

a cylindrical member extending radially from said housing so as be substantially perpendicular to said cavity, said cylindrical member having a bore in communication with said cavity;

a reciprocating member disposed within said bore;

camming means disposed within said cavity for reciprocating said reciprocating member, said camming means being disposed adjacent said first end of said housing and having an axis of cam rotation which is substantially parallel to said axis; and a transmission assembly disposed within said cavity adjacent said second end of said housing, said transmission assembly comprising:

a cylindrical sleeve having a longitudinal bore which is substantially concentric with said axis of cam rotation, said longitudinal bore having a first end and an oppositely disposed second end;

a shaft disposed within said longitudinal bore so as to extend beyond both said first and second ends, said shaft being detachably secured to said camming means for transferring rotative motion to said camming means;

needle bearing means secured within said first end of said longitudinal bore, said needle bearing means rotatably supporting said shaft within said cylindrical sleeve; and roller bearing means secured within said second end of said longitudinal bore, said roller bearing means rotatably supporting said shaft within said cylindrical sleeve;

wherein said transmission assembly comprises a unitary replaceable cartridge.

9. The profiler of claim 8 wherein said first end of said housing has an access to said cavity for receiving said camming means and said transmission assembly within said cavity.

10. The profiler of claim 8 further comprising handle means threadably secured to said housing at said second end.

11. The profiler of claim 8 further comprising biasing means within said bore of said cylindrical member for biasing said reciprocating member against said camming means.

12. The profiler of claim 8 further comprising attachment means secured to said reciprocating member for fastening a tool to said profiler.

13. The profiler of claim 8 wherein said cavity comprises an upper cavity portion disposed at said first end of said housing and a lower cavity portion disposed at said second end of said housing, said upper cavity portion containing said camming means and said lower cavity portion containing said transmission assembly.

14. The profiler of claim 13 wherein said cylindrical sleeve of said transmission assembly slidably engages said lower cavity portion so as to be supported therein.

15. The reciprocating hand tool of claim 8 wherein said housing is an aluminum housing.

16. In a profiler having a housing with a cavity disposed therein, a reciprocating member extending therefrom, and camming means disposed within said cavity for reciprocating said reciprocating member, said profiler having a transmission cartridge disposed within said cavity and in mechanical communication with said camming means for transferring rotative motion to said camming means, said transmission cartridge comprising:

a cylindrical sleeve having a longitudinal bore with a first end and an oppositely disposed second end;

a shaft disposed within said longitudinal bore, said shaft being detachably secured to said camming means for transferring rotative motion to said camming means;

elongate bearing means secured within said first end of said longitudinal bore, said elongate bearing means rotatably supporting said shaft within said cylindrical sleeve; and second bearing means secured within said second end of said longitudinal bore, said second bearing means rotatably supporting said shaft within said cylindrical sleeve.

17. The profiler of claim 16 wherein said elongate bearing means comprises a needle bearing.

18. The profiler of claim 16 wherein said second bearing means is a roller bearing.

19. The reciprocating hand tool of claim 16 wherein said housing is an aluminum housing.

* * * * *

UNITED STATES PATENT AND TRADEMARK OFFICE

CERTIFICATE OF CORRECTION

PATENT NO. : 5,212,995

DATED : May 25, 1993

INVENTOR(S) : Melvin E. Robinson and Joseph E. Robinson

It is certified that error appears in the above-identified patent and that said Letters Patent is hereby corrected as shown below:

Column 4, line 3, delete "and a bore formed within".

Signed and Sealed this

Thirty-first Day of May, 1994

Bruce Lehman

*Attest:*

BRUCE LEHMAN

*Attesting Officer*

*Commissioner of Patents and Trademarks*